United States Patent [19]

Burris, II

[11] Patent Number: 4,618,000

[45] Date of Patent: Oct. 21, 1986

[54] PUMP OPEN SAFETY VALVE AND METHOD OF USE

[75] Inventor: Wesley J. Burris, II, Duncan, Okla.

[73] Assignee: Halliburton Company, Duncan, Okla.

[21] Appl. No.: 699,962

[22] Filed: Feb. 8, 1985

[51] Int. Cl.[4] ..... E21B 34/06

[52] U.S. Cl. ..... 166/373; 166/317; 166/319

[58] Field of Search ..... 166/317, 319, 323, 373, 166/374

[56] References Cited

U.S. PATENT DOCUMENTS

| | | | |
|---|---|---|---|
| 2,033,563 | 3/1936 | Wells . | |
| 3,071,151 | 1/1963 | Sizer . | |
| 3,750,752 | 8/1973 | Mott | 166/319 |
| 3,814,181 | 6/1974 | Young . | |
| 3,826,309 | 7/1974 | Tausch . | |
| 3,842,913 | 10/1974 | Mott . | |
| 3,850,238 | 11/1974 | Hill . | |
| 3,860,066 | 1/1975 | Pearce et al. . | |
| 3,970,147 | 7/1976 | Jessup et al. | 166/323 |
| 4,063,593 | 12/1977 | Jessup . | |
| 4,064,937 | 12/1977 | Barrington . | |
| 4,160,484 | 7/1979 | Watkins | 166/323 |
| 4,270,610 | 6/1981 | Barrington | 166/317 |
| 4,403,659 | 9/1983 | Upchurch . | |
| 4,441,558 | 4/1984 | Welch et al. | 166/317 |
| 4,530,485 | 7/1985 | Yonker et al. | 166/319 |

*Primary Examiner*—Stephen J. Novosad
*Assistant Examiner*—Bruce M. Kisliuk
*Attorney, Agent, or Firm*—Joseph A. Walkowski

[57] ABSTRACT

A downhole safety valve has a ball valve element which is closed in response to an increase in well annulus pressure and which may be re-opened in response to an increase in tubing pressure.

20 Claims, 7 Drawing Figures

PUMP OPEN SAFETY VALVE AND METHOD OF USE

BACKGROUND OF THE INVENTION

1. Field Of The Invention

This invention relates to pressure responsive well tools, and more particularly to a pressure responsive safety valve.

2. Description Of The Prior Art

In both drilling and production operations, conditions sometimes occur which make it necessary to quickly close the drill string tubing or production tubing in order to shut off flow of fluid from the formation.

Tubing string valves for use in drilling, testing and producing wells are well known.

Such valves are often constructed to be responsive to changes in well annulus pressure. Two examples of such annulus pressure responsive valves are U.S. Pat. Nos. 4,064,937 to Barrington and U.S. Pat. No. 4,063,593 to Jessup, both assigned to the assignee of the present invention. In both of these references, the well annulus pressure is applied to one side of a power piston defined on an actuating mandrel, and the other side of the power piston is in communication with a sealed low pressure zone.

Another manner of operating such a device is shown in U.S. Pat. No. 3,814,181 to Young which discloses a safety valve which utilizes the ambient well annulus pressure, rather than an artificial change in well annulus pressure, to operate a safety valve in response to sensed changes in pressure within the production tubing.

Also, other safety valves have been designed to be operated by artificially imposed changes in pressure within the production tubing, such as seen for example in U.S. Pat. No. 3,850,238 to Hill.

SUMMARY OF THE INVENTION

The present invention provides a safety valve which utilizes increases in well annulus pressure, as applied to the first side of a power piston which has a second side in communication with a sealed low pressure zone, to induce a closing action of the safety valve. The safety valve is releasably locked in this closed position. Subsequently, the safety valve can be reopened by increasing the pressure within the tubing string to create a downward pressure differential across the closed valve and an actuating mandrel to which it is connected. This downward pressure differential shears a set of shear pins in the releasable locking means, to allow the safety valve to be returned to its open position.

The safety valve of the present invention is particularly adapted to use in an offshore well testing string. The safety valve is normally closed after the testing program is completed. The safety valve of the present invention can, however, be reopened by applying pressure in the tubing bore so that formation fluid produced during the testing operation can be pumped back down into the well. This eliminates the problem of disposal of the produced formation fluid.

Numerous objects, features and advantages of the present invention, and of the more general principle of use of either well annulus pressure or tubing pressure to provide a first actuating movement of a tool, and the use of the other to provide a second actuating movement of a tool, will be readily apparent to those skilled in the art upon a reading of the following disclosure when taken in conjunction with the accompanying drawings.

OVERALL WELL TESTING ENVIRONMENT

When it is desired to test the production capabilities of the formation during the drilling of an oil or gas well, a testing string is lowered into the bore hole to the formation depth. The valves in the testing string are in an open position to permit the string to fill with well bore fluid. When the testing depth is reached, well fluid is displaced out of the testing string with a less dense fluid, such as diesel, after which a packer on the testing string is set to seal the bore hole thus isolating the formation from the hydrostatic pressure of drilling fluid in the well annulus. A perforating gun or guns in series is then lowered through the testing string via wireline to perforate the casing adjacent the producing formation. Formation fluids will then be produced against the head of the diesel cushion. The formation can be closed in by applying pressure in the well bore annulus surrounding the testing string, to close a tester valve in the string. To permit another flow of formation fluid, annulus pressure is released.

The testing program includes periods of formation flow and periods when the formation is closed in. Pressure recordings are taken throughout the program to determine the production capability of the formation.

Figure 1:
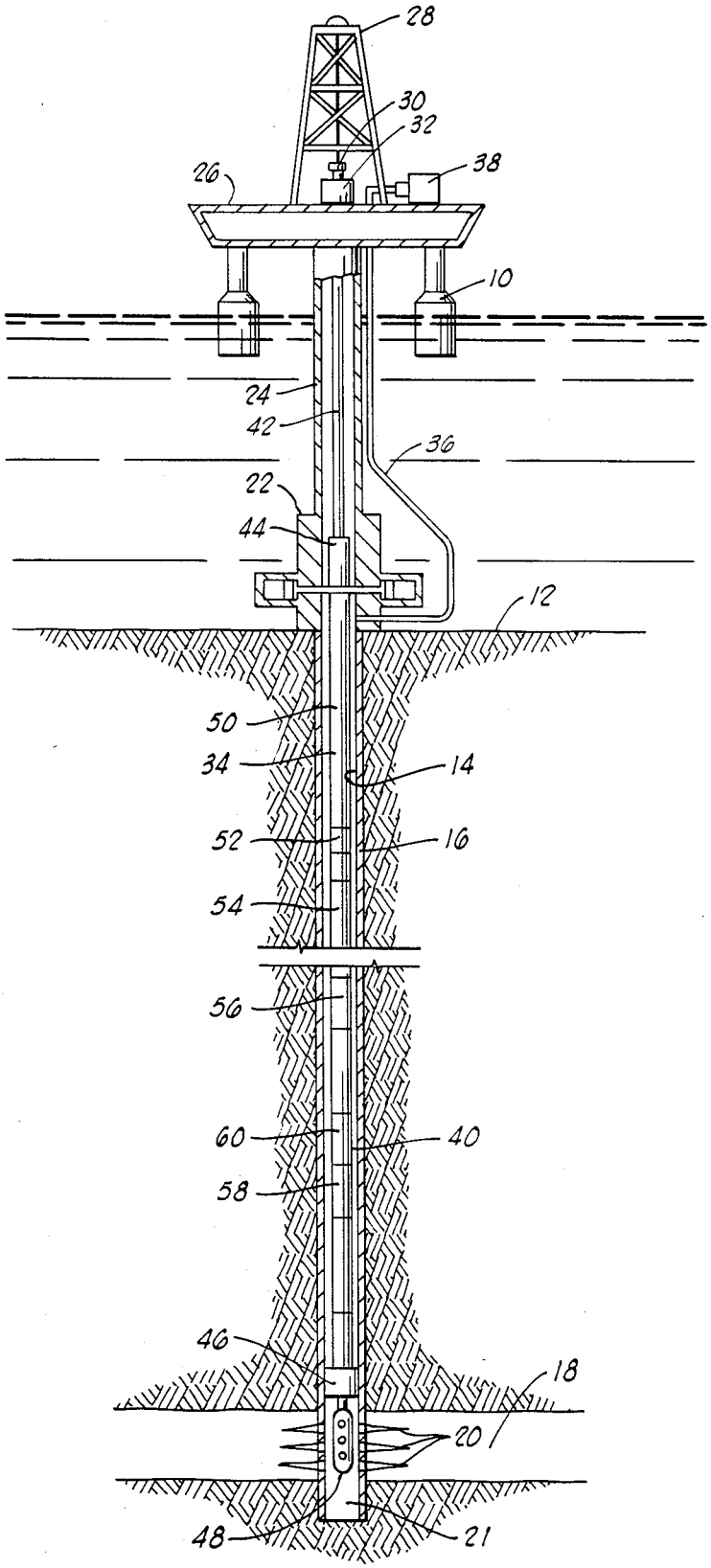
FIG. 1 is a schematic elevational view of a typical well testing apparatus utilizing the present invention.

A typical arrangement for conducting a drill stem test offshore is shown in FIG. 1. Such an arrangement would include a floating work station 10 stationed over a submerged work site 12. The well comprises a well bore 14 typically lined with a casing string 16 extending from the work site 12 to a submerged formation 18. The casing string 16 includes a plurality of perforations 20 at its lower end which provide communication between the formation 18 and the interior 21 of the well bore 14.

At the submerged well site 12 is located a well head mechanism 22 which includes blowout preventer mechanisms.

A marine conductor 24 extends from the well head 22 to the floating work station 10. The floating work station 10 includes a work deck 26 which supports a derrick 28.

The derrick 28 supports a hoisting means 30. A well head closure 32 is provided at the upper end of the marine conductor 24. The well head closure 32 allows for lowering into the marine conductor 24 and into the well bore 14 a formation testing string 34 which is raised and lowered in the well by a hoisting means 30.

A supply conduit 36 is provided which extends from a hydraulic pump 38 on the deck 26 of the floating station 10 and extends to the well head installation 22 at a point below the blowout preventers to allow the pressurizing of the well annulus 40 between the test string 34 and the well bore 14 of casing string 16.

The testing string 34 includes an upper conduit string portion 42 extending from the work station 10 to the well head installation 22. A hydraulically operated conduit string test tree 44 is located at the lower end of the upper conduit string portion 42 and is landed in the well head installation 22 to thus support the lower portion of the formation testing string 34.

The lower portion of the formation testing string 34 extends from the test tree 44 to the formation 18.

A packer mechanism 46 isolates the formation 18 from the fluids in the well annulus 40. A perforating gun 48 is run via wireline to the lower end of the formation testing string 34 to perforate casing string 16 adjacent formation 18 and allow fluid communication between the formation 18 and the interior or tubing bore of the tubular formation testing string 34.

The lower portion of the formation testing string 34 further includes an intermediate conduit portion 50 and torque transmitting pressure and volume balanced slip joint means 52. An intermediate conduit portion 54 is provided for imparting packer setting weight to the packer mechanism 46 at the lower end of the test string 34.

It may be desirable to place near the lower end of the testing string a conventional circulating valve 56 which may be opened by rotation or reciprocation of the testing string, a combination of both, by the dropping of an opening bomb in the interior of the testing string 34, or by application of a plurality of pressure changes in well bore 14 above packer mechanism 46.

Also near the lower end of the formation testing string 34 is located a tester valve 58 which is preferably a tester valve of the annulus pressure operated type which closes upon the application of well annulus pressure and re-opens when the well annulus pressure is returned to ambient levels.

Located immediately above the tester valve 58 is the safety valve 60 of the present invention. The safety valve 60 is designed to close at a well annulus pressure greater than that which is required to operate the tester valve 58.

DETAILED DESCRIPTION OF THE PREFERRED EMBODIMENT

Referring now to FIGS. 2A–2D, the safety valve 60 of the present invention is there shown in a detailed elevation, right-side only sectioned view. The safety valve 60 may generally be referred to as a downhole tool apparatus.

Safety valve 60 includes a housing 62 comprised of an upper adapter 64, a shear set housing section 66, a power housing section 68, a release housing section 70, a ball valve housing section 72, and a lower adapter 74.

Upper adapter 64 and shear set housing section 62 are threadedly connected at 76 with a seal being provided therebetween by O-ring 78.

Shear set housing section 66 and power housing section 68 are threadedly connected at 80 with a seal being provided therebetween by O-ring 82.

Power housing section 68 and release housing section 70 are threadedly connected at 84 with a seal being provided therebetween by O-ring 86.

Release housing section 70 and ball valve housing section 72 are threadedly connected together at 88 with a seal being provided therebetween by O-ring 90.

Ball valve housing section 72 and lower adapter 74 are threadedly connected together at 92 with a seal being provided therebetween by O-ring 94.

Housing 62 has a housing bore 96 disposed entirely through the length thereof.

Upper adapter 64 includes an internally threaded box connection 98 for connection to those portions of the well test string 34 located thereabove, so that the housing bore 96 will be communicated with the bore of the well testing string 34. The well testing string 34 may be generally referred to as a tubing string, and its bore may generally be referred to as a tubing bore which is communicated with the housing bore 96.

Safety valve 60 includes a rotatable ball valve 100, which may generally be referred to as an operating element 100, which is disposed within the housing 62. Ball valve 100 is shown in FIG. 2C in its open position with its ball valve bore 102 aligned with and defining a portion of the housing bore 96. The ball valve 100 can be rotated so that its valve bore 102 is rotated 90° to close the housing bore 96 and prevent the flow of fluids therethrough past the ball valve 100.

The safety valve 60 includes an actuating means generally and collectively designated by the numeral 104. The actuating means 104 is operably associated with the ball valve 100 for closing and then re-opening the ball valve 100 in a manner further described below.

Actuating means 104 includes a closing mandrel 106 which may generally be referred to as a first actuating mandrel 106, disposed in the housing 62.

The closing mandrel 106 has a power piston 108 disposed thereon. Power piston 108 is slidably received within a cylindrical enlarged diameter piston bore 110 of power housing section 68, and includes a sliding piston seal 112 disposed in an outer annular groove 114 of power piston 108 for sealing between power piston 108 and piston bore 110.

A lower first side 116 of power piston 108 is communicated with the well annulus 40 through a power port 118 disposed through the side wall of power housing section 68. An upper second side 120 of power piston 108 is communicated with a sealed low pressure zone 122 defined between opening mandrel 106 and power housing section 68. Low pressure zone 122 contains air which initially is at approximately atmospheric pressure and temperature before the well test string 34 is placed in the well.

A plurality of O-ring seals 124 are disposed between closing mandrel 106 and a bore 126 of power housing section 68 to seal the upper end of sealed low pressure zone 122.

A shock absorber ring 128 is disposed immediately adjacent upper side 120 of power piston 108 to prevent damaging impact of power piston 108 with the upper end of the sealed low pressure zone 122.

In a manner to be described in more detail below, the closing mandrel 106 is moved upward within housing 62 in response to an increase in pressure within the well annulus 40 which creates an upward pressure differential across the power piston 108. This upward movement will cause the ball valve 100 to be rotated to a closed position closing the housing bore 96.

An upper shear pin set 130, which may generally be referred to as a first releasable locking means 130, is operably associated with the closing mandrel 106 for releasably locking the ball valve in its initial open position as illustrated in FIGS. 2A-2D. The shear set 130 locks the closing mandrel 106 in its initial position, and accordingly holds the ball valve 100 in its initial open position until the pressure in well annulus 40 exceeds the pressure in the sealed low pressure zone 122 by a predetermined amount thus applying an upward force on the shear set 130 sufficient to shear the shear pins 132 thereof.

The shear set 130 includes the plurality of shear pins 132 which are disposed through aligned radial bores of inner and outer tubular cylindrical sleeves 134 and 136. An outer retaining sleeve 138 holds the shear pins 132 in place.

An upper end of outer sleeve 136 abuts a downward facing annular surface 140 of shear set housing section 66 to prevent upward movement thereof.

A lower end 142 of inner sleeve 134 is arranged to be engaged by an upward facing annular surface 144 of closing mandrel 106, so that upward forces applied to closing mandrel 106 by power piston 108 are applied in shear across the shear pins 132.

At the upper end of closing mandrel 106, a cylindrical outer surface 146 thereof is slidably received within a cylindrical counterbore 148 of upper adapter 64.

Actuating means 104 further includes an opening mandrel assembly 150 which may be referred to as a second actuating mandrel 150, which is slidably disposed in the housing 62 and is operably associated with the ball valve 100 so that after the ball valve 100 has been moved to its closed position by closing mandrel 106, it can be reopened by increasing the pressure within the tubing bore of tubing string 34 above safety valve 60 and within an upper portion 152 of housing bore 96 above the ball valve 100.

When the tubing pressure is increased above the closed ball valve 100, this will create a downward pressure differential across the opening mandrel 150 in a manner further described below, to move the opening mandrel 150 and the ball valve 100 downward and to rotate the ball valve back to an open position like that shown in FIG. 2C.

The opening mandrel 150 includes an upper opening mandrel section 154 located above ball valve 100 and includes a lower opening mandrel section 156 located below ball valve 100.

An upper seat holder 158 is threadedly connected to upper opening mandrel section 154 at threaded connection 160 with a seal being provided therebetween by O-ring 162.

An upper annular valve seat 164 is closely received within a lower counterbore 166 of upper seat holder 158 with a seal being provided therebetween by O-ring 168. A flat annular spacer ring 170 is received in counterbore 166 above upper valve seat 164.

A lower valve seat holder 172 is threadedly connected to the upper end of lower opening mandrel section 156 at threaded connection 174 with a seal being provided therebetween by O-ring 176.

A lower valve seat 178 is closely received within an upper counterbore 180 of lower valve seat holder 172 with a seal being provided therebetween by O-ring 182.

Two opposing Belleville type springs 186 are received in counterbore 180 below lower valve seat 178.

The ball valve 100 is sealingly received between upper and lower valve seats 164 and 178.

The upper and lower seat holders 158 and 172 are held in position about ball valve 100 by a plurality of C-shaped clamps 188 of which only the upper and lower ends 190 and 192 appear in FIG. 2C.

A longitudinally extending arcuate cross-section actuating arm 194 is held longitudinally fixed in place relative to housing 62 between upper and lower bearing rings 196 and 198.

The upper bearing ring 196 abuts a lower end of release housing section 70, and has an O-ring 200 and a spacer ring 202 located in an upper radially inner groove thereof.

An upper end 204 of actuating arm 194 is received within a lower radially outer annular groove 206 of upper bearing ring 196. A lower end 208 of actuating arm 194 is received within an upper radially outer annular groove 210 of lower bearing ring 198.

An actuating lug 212 extends radially inward from actuating arm 194 and engages an eccentric actuating bore 214 of ball valve 100.

There is another actuating arm like the actuating arm 194 which is not visible in the drawings and which is circumferentially located from the actuating arm 194 and engages a second eccentric bore such as 214 of the ball valve 100, so that when the ball valve 100 is moved longitudinally upward relative to the housing 62 from its initial open position shown in FIG. 2C, the ball valve 100 will be rotated to a closed position closing the housing bore 96. Similarly, if the ball valve 100 is then moved back downward longitudinally relative to the housing 62 to its position shown in FIG. 2C, it will be rotated back to its open position like that shown in FIG. 2C.

The lower opening mandrel section 156 has a cylindrical outer surface 216 closely and slidably received within an upwardly open counterbore 218 of lower adapter 74 with a sliding seal being provided therebetween by O-ring 220.

When the ball valve 100 is in a closed position, any subsequent increase in pressure applied to the tubing bore of tubing string 34 and to the upper portion 152 of housing bore 96 above the closed ball valve 100 will create a downwardly acting differential pressure across the closed ball valve 100 and the opening mandrel 150, with the differential pressure area being the circular area within counterbore 218 as defined by the sliding seal 220.

As seen in FIG. 2C, a releasable connecting means 222 is operably associated with the closing mandrel 106 and the upper section 154 of opening mandrel 150 for releasably connecting the closing mandrel 106 and the opening mandrel 150 when the ball valve 100 is in its initial open position as seen in FIG. 2C.

Releasable connecting means 222 includes a plurality of upwardly extending spring collet fingers 224 which are integrally formed on the upper end of upper opening mandrel section 154.

Each of the collet fingers 224 has a head 226 defined thereon. Each of the heads 226 further has defined thereon a lower radially inner tapered annular surface 228 and a lower radially outer tapered annular surface 230.

Releasable connecting means 222 further includes a radially outward extending annular ridge 232 defined on a lower portion of closing mandrel 106, and having defined thereon an upper tapered annular surface 234 adapted for engagement with the inner tapered surface 228 of the heads 226.

When the closing mandrel 106 and the opening mandrel 150 are initially releasably connected together as shown in FIG. 2C, a lower end 236 of opening mandrel 106 abuts an upward facing annular surface 238 of upper opening mandrel section 154 and is held in place relative thereto due to the fact that the ridge 222 is trapped below the heads 226 of collet fingers 224.

To close the ball valve 100, as previously described, pressure is increased in the well annulus 40 which is applied through power port 118 to the lower side 116 of power piston 108. When the upward force applied to the closing mandrel 106 is sufficient, the shear pins 132 of shear set 130 are sheared, and the closing mandrel 106 then moves upward relative to the housing 62.

Due to the connection between closing mandrel 106 and opening mandrel 150 by releasable connecting means 222, the opening mandrel 150 and the ball valve 100 are pulled longitudinally upward relative to housing 62 by the closing mandrel 106.

This upward movement of ball valve 100 relative to the housing 62 and relative to the lugs 212 of actuating arms such as 194 which are longitudinally fixed relative to housing 62 causes the ball valve 100 to be rotated to a closed position.

When the outer tapered surfaces 230 of heads 226 of collet fingers 224 reach a tapered transition surface 240 of release housing section 70, the heads 226 are biased radially outward by the spring collet fingers 224 into an increased internal diameter bore portion 242 of release housing section 70 thus allowing the ridge 222 of closing mandrel 106 to move further upward past the inner tapered surfaces 228 of heads 226, thus releasing the closing mandrel 106 from the opening mandrel 150.

Figure 2A:
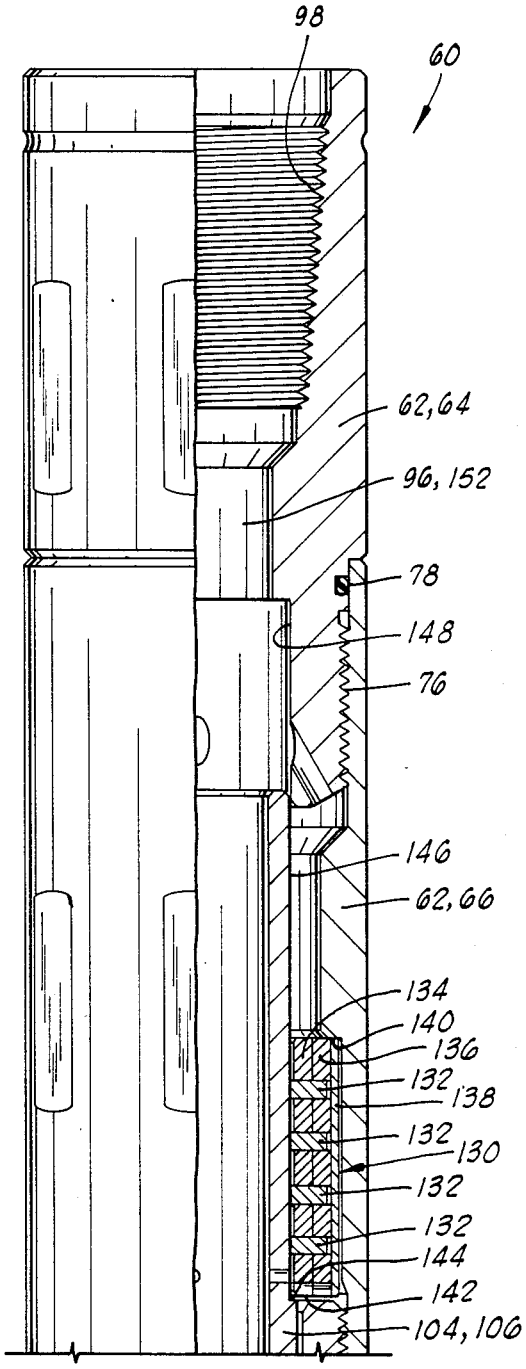
FIGS. 2A–2D comprise an elevational right-side only section detailed view of the safety valve of the present invention in its initial open position.
Figure 2B:
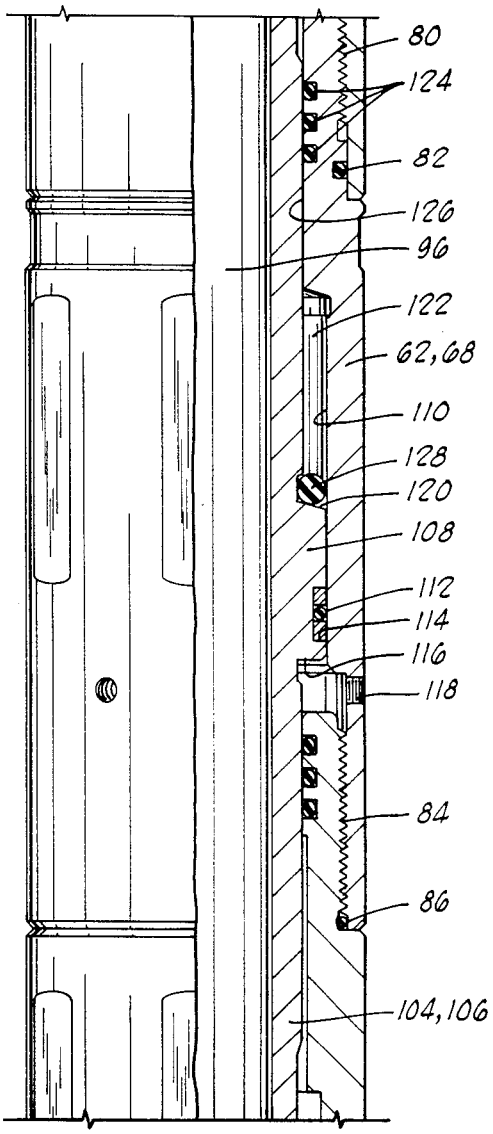
Figure 2C:
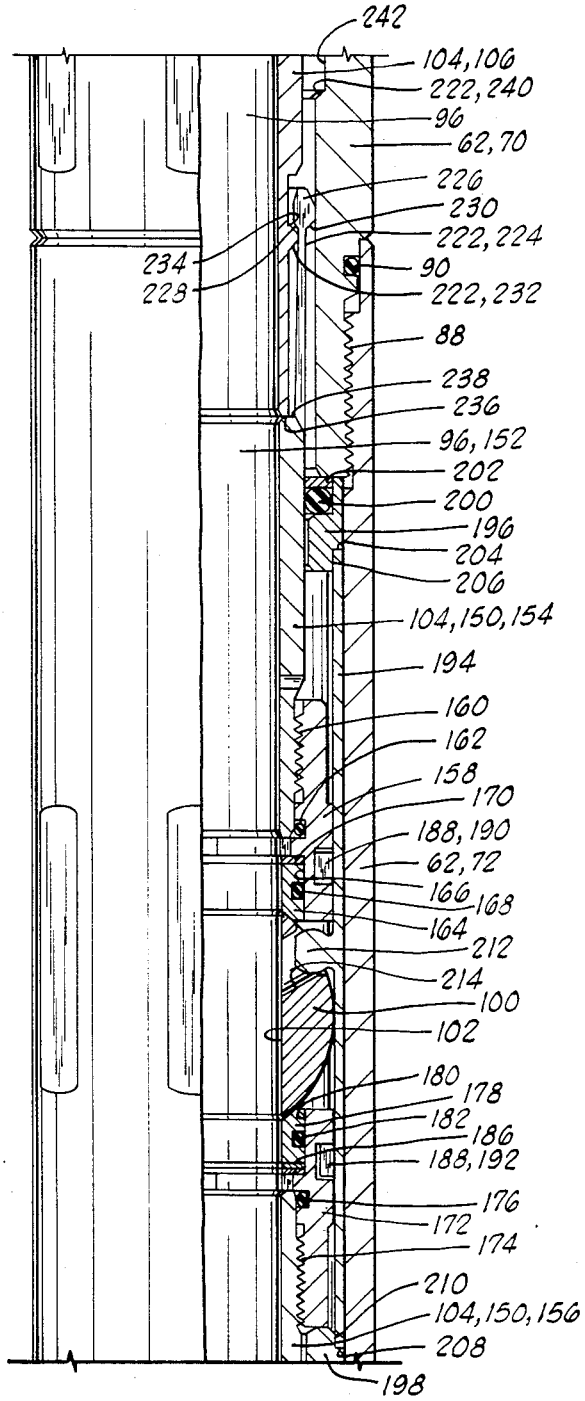
Figure 2D:
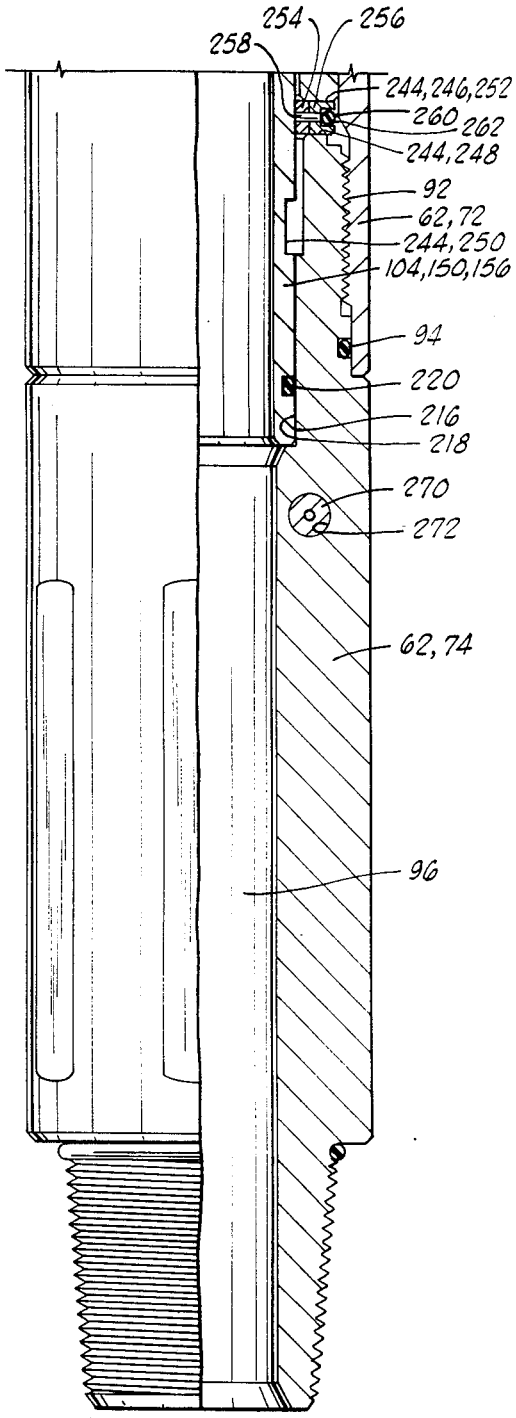

Referring now to FIG. 2D, a releasable locking means 244 is thereshown. Releasable locking means 244 is operably associated with the opening mandrel 150 for releasably locking the opening mandrel in its uppermost position corresponding to the closed position of the ball valve 100. The releasable locking means 244 will subsequently release the opening mandrel 150 and the operably associated ball valve 100 to allow the ball valve 100 to be reopened when a downward pressure differential acting across the closed ball valve 100 and the opening mandrel 150 reaches a predetermined level as further described below.

The releasable locking means 244 includes a radially contractable shear set group 246, an inwardly open annular groove 248 defined in the housing 62 and a radially outwardly open annular groove 250 defined in opening mandrel 150.

In FIG. 2D, the releasable locking means 244 is shown in its initial position corresponding to the initial open position of the ball valve 100. The lower shear set group 246 is disposed in the inwardly open groove 248, and the outwardly open groove 250 is located below the lower shear set group 246 and the inwardly open groove 248.

The lower shear set group 246 includes a plurality of separable arcuate shear sets such as 252, only one of which is seen in FIG. 2.

Shear set 252 includes a radially inner piece 254 and a radially outer piece 256 joined together by a plurality of shear pins such as 258. The shear pins 258 are received within aligned radial bores disposed through the radially inner and outer pieces 254 and 256.

A resilient endless band 260 is received within radially outer groove portions 262 of the outer pieces 256. The resilient band 260 may also be referred to as a radial biasing means 260 operably associated with the plurality of shear sets such as 252 for biasing the plurality of shear sets 252 radially inward toward lower opening mandrel section 156 and particularly toward the outwardly open groove 250 thereof when the outwardly open groove 250 becomes longitudinally aligned with the inwardly open groove 248.

Figure 3:
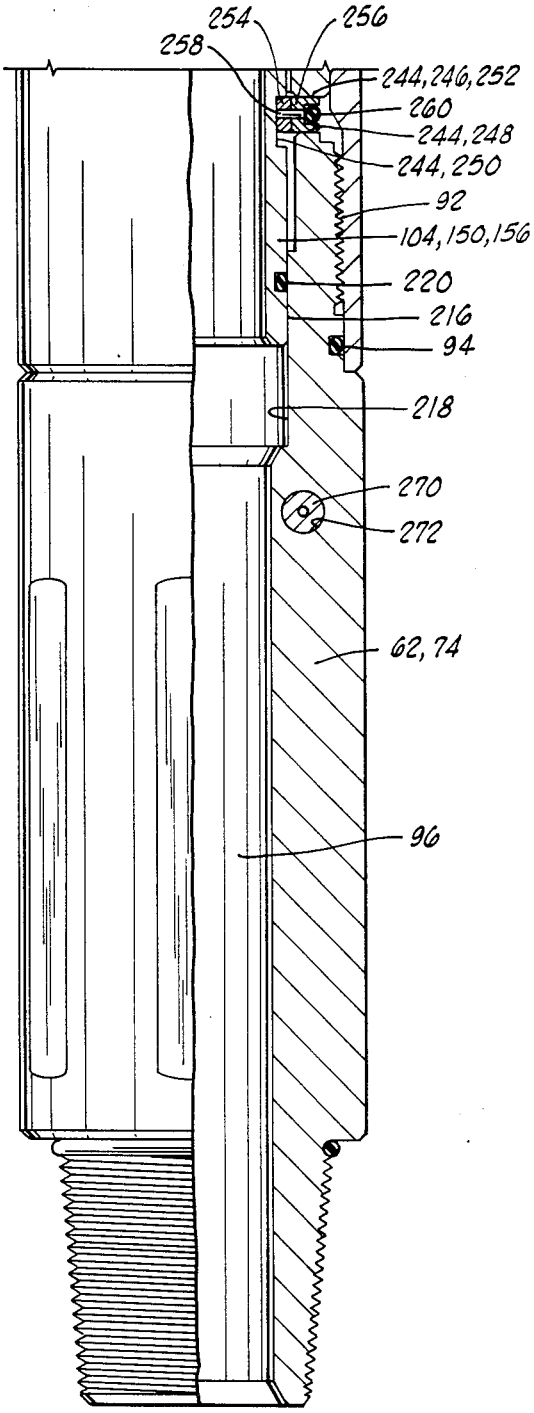
FIG. 3 is similar to the lower section of the apparatus shown in FIG. 2D, and illustrates the position of the actuating means after the ball valve has been closed and when the ball valve is releasably locked in its closed position.

FIG. 3 illustrates the position of the releasable locking means 244 after the closing mandrel 106 has moved the opening mandrel 150 and the ball valve 100 upward to rotate the ball valve 100 to its closed position. In this position, the outwardly open groove 250 is longitudinally aligned with the inwardly open groove 248, and the shear sets such as 252 have been moved radially inward by the resilient band 260 so that the radially inner pieces such as 254 thereof are received within the outwardly open groove 250 of lower opening mandrel section 156, and so that the radially outer pieces such as 256 thereof are still received within the radially inwardly open groove 248.

This releasably locks the opening mandrel 150 in its uppermost position corresponding to the closed position of ball valve 100. The opening mandrel 156 and ball valve 100 will remain in this position until a sufficient downward force is exerted upon opening mandrel 150 and across the shear pins 258 of shear set group 246 to shear the shear pins 258 thus releasing the opening mandrel 150 and allowing it to move longitudinally downward relative to housing 62 to reopen the ball valve 100.

This downward force as applied to upper opening mandrel section 154 will cause the heads 226 of collet fingers 224 to be cammed radially inward due to the interaction of tapered surfaces 230 and 240.

Figure 4:
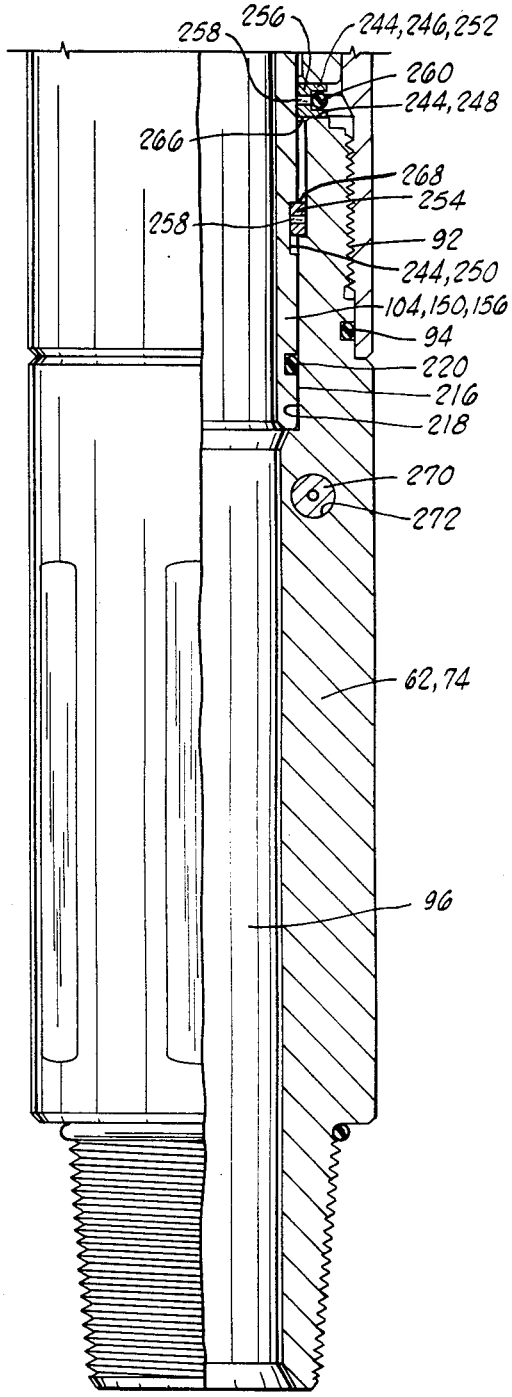
FIG. 4 is another view similar to FIGS. 2D and 3 illustrating the position of the actuating means and of the releasable locking means after the safety valve has been re-opened by the application of tubing pressure.

FIG. 4 illustrates the final position of lower opening mandrel section 156 corresponding to the reopened position of the ball valve 100.

It is seen in FIG. 4 that the shear pins 258 have sheared, and that the radially inner pieces 254 of shear sets 252 remain trapped within the radially outwardly open groove 250 and move downward with the opening mandrel 150, while the radially outer pieces 256 of shear sets 252 remain trapped within the radially inwardly open groove 248 and are further biased radially inward by resilient band 260 so that they engage the radially outer cylindrical surface 256 of lower opening mandrel section 216.

It is noted that due to this further radially inward movement of the radially outer pieces 256 of shear sets 252, the lower sides 266 of radially outer pieces 256 of shear sets 252 are in a position to abut the upper sides 268 of radially inner pieces 254, so that the opening mandrel is prevented from moving back upward to a position such as that in FIG. 3 corresponding to the fully closed position of ball valve 100, thus the ball valve 100 is prevented from ever moving back to a fully closed position.

The shear set group 246 and particularly the arcuate shear sets 252 are constructed from two concentric annular rings which ultimately become the radially inner and outer pieces 254 and 256. These concentric rings are held together by the shear pins 258, and then are cut along radial lines to form the arcuate shear sets 252.

Also partly shown in FIGS. 2D, 3 and 4, is a bleeder valve assembly 270 disposed in a transverse bore 272 of lower adapter 74 for permitting fluid trapped within the housing bore 96 to be relieved therefrom under controlled conditions after the well testing string 34 is returned to the work station 10.

SUMMARY OF OPERATION OF THE INVENTION

The safety valve 60 may be generally described as including the housing 62 having a threaded upper end 98 adapted to be connected to the remainder of the tubing string 34, and having the housing bore 96 adapted to be communicated with the tubing bore of the tubing string 34.

The operating element or ball valve 100 is disposed within the housing 62.

The actuating means 104 is generally described as being operably associated with the operating element 100 for inducing a first closing actuating movement of the operating element 100 from the first open position of operating element 100 seen in FIG. 2C to a second closed position of the operating element 100 in response to a change in pressure in one of the well annulus 40 outside the housing 62 and the tubing bore of tubing string 34 as communicated with the housing bore 96. Particularly, this first actuating movement is accomplished in response to an increase in pressure within the well annulus 40 which exceeds the pressure trapped within sealed low pressure zone 122 thus creating an upward pressure differential on power piston 108.

Actuating means 150 may also be generally described as a means for inducing a second reopening actuating movement of the operating element 100 from its closed second position to a reopened third position thereof relative to the housing 62 in response to a change in pressure within the other of said tubing bore of tubing string 34 and said well annulus 40 outside the housing 62. Particularly, the second reopening actuating movement is induced in response to an increase in pressure within the tubing bore of tubing string 34 and within the upper portion 152 of housing bore 96 above the closed operating element 100. This creates a downward pressure differential across the operating element 100 and the opening mandrel 150, and particularly across the circular differential area defined within seal 220, due to the higher pressure within tubing bore 96 above operating element 100 as compared to the pressure within tubing bore 96 below operating element 100.

It can generally be said that at least one of these first and second acutating movements is induced in response to a relative pressure other than that existing between the well annulus 40 and the tubing bore. That is, the actuating movements are not both induced in response to differential pressures between the tubing bore and the well annulus.

In fact, in the particular embodiment of the invention illustrated in the present application, both of the actuating movements are in response to a relative pressure differential other than that existing between the well annulus 40 and the tubing bore.

In the disclosed embodiment, the first closing actuating movement is induced in response to the relative pressure differential between the well annulus 40 and the sealed low pressure zone 122. In the second reopening actuating movement, the movement is induced in response to the relative pressure differential within the tubing bore 96 above and below the seal 220.

The initial open position of the ball valve 100 as seen in FIGS. 2A–2D, and particularly in FIG. 2C, may generally be described as a first position. The closed position of ball valve 100 corresponding to FIG. 3 may generally be described as a second position of the ball valve 100 or operating element 100 relative to the housing 62. The reopened position of ball valve 100 corresponding to FIG. 4 may generally be referred to as a third position of the operating element 100 relative to housing 62.

It is noted that the first position of ball valve 100 corresponding to FIGS. 2A–2D, and the third position thereof corresponding to FIG. 4 are the same with regard to the ball valve 100. That is, the ball valve 100 is open in both its first and third positions.

More specifically, the operation of safety valve 60 is as follows.

The safety valve 60 is lowered into place within the well bore 14 as a part of the testing string 34 as schematically illustrated in FIG. 1.

The safety valve 60 is initially oriented as shown in FIGS. 2A–2D with the ball valve 100 in its open position, and with the ball valve 100 being releasably locked in its open position by the upper shear set 130. The shear set 130 prevents premature closure of the ball valve 100.

When the testing program is completed or some condition occurs that makes it desirable to close the bore of the well test string 34 to prevent fluids from flowing therethrough, the pressure within well annulus 40 is increased to a predetermined level determined by the number, size and material of the shear pins 132, and by the differential area on power piston 108, to apply an upward force to power piston 108 and to closing mandrel 106, to thereby shear the shear pins 132 and move the closing mandrel 106 upward relative to housing 62.

The closing mandrel 106 and the opening mandrel 150 are initially releasably connected together by the releasable connecting means 222 of FIG. 2C, so that the opening mandrel 150 and the ball valve 100 are also moved longitudinally upward relative to housing 62 by the upward movement of closing mandrel 106.

As the ball valve 100 is moved longitudinally upward relative to housing 62 it is rotated to a closed position by the actuating lugs 212.

When the heads 226 of collet fingers 224 move upward past the annular tapered transition surface 240 of release housing section 70, the collet fingers 224 spring radially outward thus allowing the ridge 232 of closing mandrel 106 to move upward past the heads 226 thus releasing closing mandrel 106 from the opening mandrel 150.

At this same time, when the opening mandrel 150 is moved upward to a position corresponding to the closed position of the ball valve 100, the grooves 250 and 248 of the second releasable locking means 244 are longitudinally aligned as shown in FIG. 3, so that the shear sets 252 of second releasable locking means 244 are biased radially inward into engagement with the groove 250 thus releasably locking the opening mandrel 150 in its uppermost position as shown in FIG. 3 corresponding to the closed second position of the ball valve 100.

Subsequently, if it is desired to reopen the safety valve 60, this can be accomplished by increasing the pressure within the tubing bore of tubing string 34 and thus within the upper portion 152 of housing bore 96 above the closed ball valve 100 thus creating a downward pressure differential acting upon the area within seal 220.

When this downward pressure differential reaches a level sufficient to cam the heads 226 of collet fingers 224 inward and to shear the pins 258 of the shear sets 252, the opening mandrel 150 will be released upon shearing of the shear pins 258 and the opening mandrel 150 then moves downward to the position shown in FIG. 4, corresponding to a re-opened position of the ball valve 100.

In the position illustrated in FIG. 4, the radially outer pieces 256 of the locking dogs are biased further radially inward against the outer surface 216 of lower opening mandrel section 156 thus preventing the opening mandrel 150 from moving back upward to a position corresponding to a fully closed position of the ball valve 100.

Thus it is seen that the apparatus and methods of the present invention readily achieve the ends and advantages mentioned as well as those inherent therein. While certain preferred embodiments of the present invention have been illustrated for the purposes of the present disclosure, numerous changes in the arrangement and construction of parts may be made by those skilled in the art, which changes are encompassed within the scope and spirit of the present invention as defined by the appended claims.

What is claimed is:

1. A downhole tool apparatus, comprising:

a housing having an upper end adapted to be connected to a tubing string, and having a housing bore adapted to be communicated with a tubing bore of said tubing string;

an operating element disposed in said housing; and actuating means including a first pressure responsive actuating mandrel for inducing movement of said operating element from a first position to a second position in response to a pressure change in one of said tubing bore or a well annulus outside said housing with respect to a first reference pressure, and a second pressure responsive actuating mandrel for inducing movement of said operating element from a second position to a third position in response to a pressure change in the other of said tubing bore or said well annulus with respect to a second reference pressure, at least one of said first and second reference pressures being provided in a sealed zone within said downhole tool apparatus.

2. The apparatus of claim 1, wherein:

said first position of said operating element relative to said housing is the same as said third position of said operating element relative to said housing.

3. The apparatus of claim 1, wherein:

said actuating means is further characterized as a means for inducing said movement of said first actuating mandrel in response to a change in pressure in said well annulus, and for inducing movement of said second actuating mandrel in response to a change in pressure in said tubing bore.

4. The apparatus of claim 1, wherein:

said operating element is a ball valve disposed in said housing bore.

5. The apparatus of claim 4, wherein:

said first and third positions of said ball valve are the same as an open position of said ball valve wherein a passage through said housing bore is open; and said second position of said ball valve is the same as a closed position of said ball valve wherein a passage through said housing bore is closed.

6. The apparatus of claim 1, wherein:

said first actuating mandrel is slidably disposed in said housing and has a power piston associated therewith, a first side of said power piston being adapted to be communicated with said well annulus and a second side of said power piston being communicated with first reference pressure in said sealed zone so that said first actuating mandrel moves said operating element from said first position to said second position in response to an increase in pressure in said well annulus with respect to said first reference pressure in said sealed zone.

7. The apparatus of claim 6, wherein:

said operating element is a ball valve disposed in said housing bore, said ball valve being in an open position wherein a passage through said housing bore is open when said operating element is in said first and third positions, and said ball valve being in a closed position closing said housing bore passage when said ball valve is in said second position; and said second actuating mandrel is slidably disposed in said housing, said ball valve being movable relative to said housing by said second actuating mandrel, so that when said ball valve is in its closed second position a change in pressure within said tubing bore and in a portion of said housing bore above said closed ball valve creates a longitudinal pressure differential with respect to said second reference pressure across said second actuating mandrel to move said second actuating mandrel and said ball valve relative to said housing.

8. The apparatus of claim 7, further comprising:

releasable connecting means, operably associated with said first and second actuating mandrels, for releasably connecting said first and second actuating mandrels when said ball valve is initially in its said first position, and for releasing said first actuating mandrel from said second actuating mandrel as said first actuating mandrel moves said ball valve from its said first position to its said second position.

9. The apparatus of claim 7, further comprising:

releasable locking means, operably associated with said second actuating mandrel, for releasably locking said ball valve in its said second position.

10. The apparatus of claim 9, wherein:

said releasable locking means is further characterized as a means for releasing said ball valve from its said second position when a downward pressure differential acting on said second actuating mandrel reaches a predetermined level.

11. The apparatus of claim 10, wherein:

said releasable locking means includes:

a plurality of shear sets disposed in an annular groove of said housing, each of said shear sets including a radially inner piece and a radially outer piece joined together by shear pin means;

a radially outer annulur groove disposed in said second actuating mandrel; and resilient radial biasing means, operably associated with said plurality of shear sets for resiliently biasing said plurality of shear sets radially inward so that when said ball valve is in its said second position, said radially inner piece of each of said shear sets is received in said radially outer annular groove of said second actuating mandrel and said radially outer piece of each of said shear sets is received in said annular groove of said housing.

12. The apparatus of claim 6, further comprising:

releasable locking means, operably associated with said first actuating mandrel for releasably locking said operating element in its first position until pressure in said well annulus exceeds a pressure in said low pressure zone by a predetermined amount.

13. A telescoping assembly, comprising:

an outer tubular member, having a radially inwardly open first annular groove disposed therein;

an inner cylindrical member telescopingly received in said outer tubular member, and having a radially outwardly open second annular groove disposed therein; and a releasable locking means for releasably locking said inner cylindrical member in a locked longitudinal position relative to said outer tubular member, when said first and second grooves are longitudinally aligned, said locking means including:

a plurality of shear sets disposed in one of said first and second grooves each of said shear sets including a radially inner piece and a radially outer piece joined together by shear pin means; and resilient radial biasing means, operably associated with said plurality of shear sets, for resiliently biasing said plurality of shear sets radially toward the other of said first and second grooves so that when said first and second annular grooves are longitudinally aligned, said radially outer piece of each of said shear sets is received in said first annular groove and said radially inner piece of each of said shear sets is received in said second annular groove.

14. The assembly of claim 13, wherein:

said plurality of shear sets is initially disposed in said first annular groove of said outer tubular member; and said radial biasing means is an endless resilient band surrounding said plurality of shear sets and biasing said shear sets radially inward toward said inner cylindrical member.

15. A method of operating a downhole tool suspended in a well from a tubing string, said method comprising the steps of:

(a) changing a pressure in one of a tubing bore of said tubing string and a well annulus surrounding said tubing string with respect to a first reference pressure;

(b) thereby inducing a first actuating movement of said tool;

(c) then changing a pressure in the other of said tubing bore and said well annulus with respect to a second reference pressure; and (d) thereby including a second actuating movement of said tool;

wherein at least one of said first and second reference pressures is provided in a sealed zone within said downhole tool.

16. The method of claim 15, wherein:

said step (a) is further characterized as increasing a pressure in said well annulus;

said step (b) is further characterized as inducing a longitudinal movement of a first actuating mandrel of said tool within a housing of said tool, said first actuating mandrel having a power piston defined thereon with a first side thereof communicated with said well annulus and with a second side thereof communicated with said sealed zone; and said step (c) is further characterized as increasing a pressure in said tubing bore.

17. The method of claim 16, said downhole tool including a housing bore disposed longitudinally through said housing and communicated with said tubing bore, said tool further including a ball valve disposed in said housing bore and being rotatable between an open position wherein said housing bore is open and a closed position wherein said housing bore is closed, wherein:

said step (b) is further characterized as moving, by means of said first actuating mandrel, said ball valve longitudinally relative to said housing and simultaneously rotating said ball valve from its said open position to its said closed position; and said method further includes a step of releasably locking said ball valve in its said closed position.

18. The method of claim 17, wherein:

said step (c) is further characterized as increasing a pressure in said tubing bore and in an upper portion of said housing bore above said closed ball valve with respect to pressure in the lower portion of said housing bore below said closed ball valve, across said closed ball valve and a second actuating mandrel operably associated with said ball valve;

(2) releasing said releasable locking means; and (3) moving said second actuating mandrel and said ball valve longitudinally downward relative to said housing and simultaneously rotating said ball valve back to said open position thereof.

19. The method of claim 18, further comprising the steps of:

prior to step (a), releasably connecting said first actuating mandrel to said second actuating mandrel so that initially said first and second actuating mandrels and said ball valve move together longitudinally relative to said housing; and prior to step (d), releasing said second actuating mandrel from said first actuating mandrel.

20. The method of claim 18, further comprising the step of:

subsequent to step (d), preventing said ball valve from returning to a fully closed position.

* * * * *